US011503909B2

(12) United States Patent
Clarke et al.

(10) Patent No.: US 11,503,909 B2
(45) Date of Patent: Nov. 22, 2022

(54) SELF CLOSING DRAWER ASSEMBLY WITH DUAL-CAM CLOSING MECHANISM

(71) Applicant: CIS GLOBAL LLC, Tuscon, AZ (US)

(72) Inventors: Wade A. Clarke, Charlotte, NC (US); Karl Klaus Dittus, Raleigh, NC (US)

(73) Assignee: CIS Global LLC, Tucson, AZ (US)

( * ) Notice: Subject to any disclaimer, the term of this patent is extended or adjusted under 35 U.S.C. 154(b) by 12 days.

(21) Appl. No.: 16/898,677

(22) Filed: Jun. 11, 2020

(65) Prior Publication Data

US 2021/0386199 A1 Dec. 16, 2021

(51) Int. Cl.

| | |
|---|---|
| ***A47B 88/467*** | (2017.01) |
| ***F25D 23/02*** | (2006.01) |
| ***A47B 88/473*** | (2017.01) |
| ***A47B 88/477*** | (2017.01) |

(52) U.S. Cl.

CPC ..... *A47B 88/467* (2017.01); *F25D 23/021* (2013.01); *A47B 88/473* (2017.01); *A47B 88/477* (2017.01); *A47B 2088/4675* (2017.01); *A47B 2210/175* (2013.01)

(58) Field of Classification Search

CPC ... A47B 88/467; A47B 88/473; A47B 88/477; A47B 2210/175; A47B 2088/4675; F25D 23/021

See application file for complete search history.

(56) References Cited

U.S. PATENT DOCUMENTS

| | | | | |
|---|---|---|---|---|
| 3,508,361 | A * | 4/1970 | Ryder | A47F 3/043 49/70 |
| 7,281,773 | B2 * | 10/2007 | Sato | E05F 1/16 312/333 |
| 7,481,505 | B2 * | 1/2009 | Orita | E05F 1/16 312/333 |
| 7,743,464 | B2 * | 6/2010 | Tomioka | E05F 3/102 16/64 |
| 8,186,010 | B2 * | 5/2012 | Tomiji | E05F 5/027 16/64 |
| 8,205,951 | B2 * | 6/2012 | Boks | A47B 88/467 312/319.1 |
| 8,844,110 | B2 | 9/2014 | Rotter | |
| 8,851,586 | B1 * | 10/2014 | Huang | A47B 88/47 312/333 |
| 10,294,706 | B2 * | 5/2019 | Demir | E05F 5/003 |
| 2006/0016279 | A1 * | 1/2006 | Sato | E05F 1/16 74/89.17 |

(Continued)

FOREIGN PATENT DOCUMENTS

| | | |
|---|---|---|
| CA | 2819278 A1 | 6/2012 |
| DE | 102013100652 A1 | 7/2014 |

(Continued)

*Primary Examiner* — Hanh V Tran

(74) *Attorney, Agent, or Firm* — Quarles & Brady LLP

(57) ABSTRACT

A self-close drawer mechanism includes a housing, a slidable self-close latch selectively positionable within the housing, a rotatable cam element in the housing, a flexible link system extending around the cam element, and a spring applying stored force to the sliding self-close latch through the flexible link. Dual cam surfaces in the cam elements realize a decreasing pull force as the user opens the drawer and provides smoother opening and closing operations with an improved user experience.

17 Claims, 14 Drawing Sheets

(56) References Cited

U.S. PATENT DOCUMENTS

| | | | | |
|---|---|---|---|---|
| 2006/0027696 | A1* | 2/2006 | Okabayashi | F16F 7/02 242/379.1 |
| 2007/0222346 | A1* | 9/2007 | Kleinsasser | A47B 88/467 312/205 |
| 2010/0007254 | A1* | 1/2010 | Zimmer | A47B 88/467 312/333 |
| 2010/0219727 | A1* | 9/2010 | Aguilar Ante | A47B 88/447 312/319.1 |
| 2011/0080080 | A1* | 4/2011 | Zimmer | A47B 88/467 312/319.1 |
| 2013/0088132 | A1* | 4/2013 | Hammerle | E05F 1/16 312/319.1 |
| 2015/0022072 | A1* | 1/2015 | Haltmeyer | A47B 97/00 312/401 |
| 2015/0374125 | A1* | 12/2015 | Goetz | A47B 88/467 312/319.1 |
| 2016/0258195 | A1* | 9/2016 | Fukumoto | E05B 77/42 |
| 2017/0196356 | A1* | 7/2017 | Gasser | A47B 88/467 |
| 2017/0265644 | A1* | 9/2017 | Fischer | F16C 29/005 |
| 2018/0203395 | A1* | 7/2018 | Kang | G03G 15/6508 |
| 2019/0086852 | A1* | 3/2019 | Goto | B65H 29/52 |

FOREIGN PATENT DOCUMENTS

| | | | |
|---|---|---|---|
| DE | 102014012961 | B3 | 12/2015 |
| EP | 3478916 | B1 | 4/2021 |

* cited by examiner

STATE OF THE ART

SELF CLOSING DRAWER ASSEMBLY WITH DUAL-CAM CLOSING MECHANISM

BACKGROUND OF THE INVENTION

The field of the invention relates generally to self-closing mechanisms for drawers, and more specifically to an appliance self-closing drawer assembly with an optimized force dual-cam closing mechanism.

Storage drawers are prolific in a wide variety of cabinetry and furniture items, and appliances. Conventional storage drawers are designed to be slidably opened and closed relative to a cabinet or other support structure in an entirely manual manner, with the ultimate position of the drawer being determined by the user. That is, the drawer can be easily positioned manually by the user in a fully opened position, a fully closed position, or anywhere in between the fully opened and fully closed position. Occasionally, however, the drawer can be inadvertently opened, for example, when snagged by a clothing item or another item carried by a user, or when accidentally bumped. The drawer can also inadvertently be left partly open by a user in a position protruding from the cabinet or other support structure for the drawer. Inadvertent opening or partly opened drawers can undesirably render a living space unsightly, but perhaps more importantly partly opened drawers may create a hazard to persons walking or working nearby. For persons that may not expect the drawer to be open or fail to realize that it is open, opportunities to collide with the protruding drawer are presented. Such collisions may result in possible damage to the drawer or personal injury.

In the case of an appliance such as a refrigerator, any inadvertent opening of a drawer or incomplete closure of a drawer may go unnoticed for some period of time and can compromise the operation of the appliance altogether by allowing cool air to escape from the refrigerator and cause refrigeration compartments to warm. Accidental defrosting of freezer compartments may occur, and the refrigeration system may be overstressed and at best consume more energy that it should and at worst contribute to a premature failure of the refrigeration system.

In view of the above, self-close and soft-close drawers have more recently been developed including automatic closing mechanisms. Such self-closing drawers remain closed under stored mechanical force unless opened by a user with sufficient counterforce, and therefore prevent inadvertent drawer opening while silently assisting and completing the drawer closing process using stored force to ensure that the drawer completely closes. Self-close drawers provide a unique user interaction experience with distinct high-quality product feel and luxury, and accordingly are now popular and in widespread use in a variety of applications such as, for example only, in kitchen and bath cabinetry as well as in appliances of various types.

Conventional self-close drawer mechanisms for kitchens, baths and appliances have been well received in the market and are in much demand, but are nonetheless problematic in some aspects. Improvements are accordingly desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In order to understand the invention to its fullest extent, a brief explanation of the state of the art concerning self-close drawer mechanisms and certain disadvantages presented in the state of the art is believed to be warranted, followed by a detailed description of exemplary embodiments of self-closing drawer mechanisms that overcome the disadvantages in the state of the art.

In general, industry standard self-close drawer mechanisms typically include a housing that attaches to a supporting cabinet, a sliding and rotating self-close latch attached to the housing, a catch latch that attaches to the drawer or a slide/rail attached to the drawer, a spring, and in the case of a soft-close mechanism a damper to gently regulate the closing force.

In conventional self-closing drawer mechanisms, the spring connects at one end to the self-close latch and to the housing at its other end, such that spring force is applied to the self-close latch. As the drawer is pulled open by a user, the pulling force is transferred through the catch latch into the self-close latch, causing a spike in initial pull force due to preloaded tension in the spring as shown in the force distance chart in FIG. 14. The drawer will not be opened unless the user overcomes the spike in initial pull force.

Figure 14:
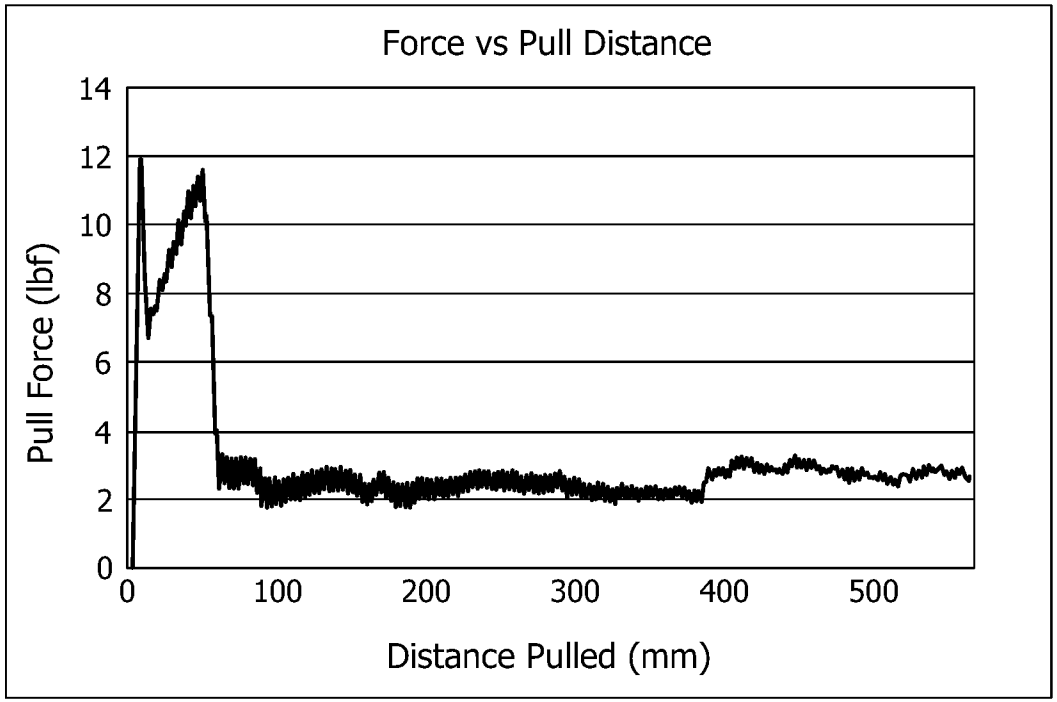
FIG. 14 is a force versus distance chart for a conventional self-close drawer mechanism.

As further seen in FIG. 14, when the drawer is further pulled open past initial spike in pull force, the self-close latch is dragged along a guided path and the pulling force increases due to the extending action of the spring (spring-loading). The pulling force ramps or increased as the drawer is extended open until a maximum pull force is eventually reached just before the self-close mechanism reaches its unlatched position wherein the self-close latch assumes a lockout position where it is rotated angularly to release the catch latch release of the drawer. The release of the catch release in turn, causes a sudden drop-off in pull force as seen in FIG. 14. The sudden drop-off in force is typically accompanied by a jerk in the motion of the drawer as the user continues to pull the drawer in an amount to overcome the maximum force which unbeknownst to the user is no longer needed.

Such a jerk in the motion of the drawer at the end of the unlatching of the mechanism can be jarring for some users because it is typically unexpected and undesired from the user's perspective. An experienced user can perhaps learn to control the applied pulling force to avoid a sudden acceleration of the drawer as the mechanism unlatches, but in general the likelihood of a jerk in the motion of the drawer negatively impacts the user experience. Once the self-close mechanism is unlatched, however, the self-close latch is locked in the lockout position by spring force, retaining the kinetic energy needed to pull the drawer closed once activated by the user. To activate the mechanism, the user pushes the drawer back toward its original closed position until the drawer catch latch re-engages the self-close latch of the mechanism. Once the mechanism is again latched, the stored force in the spring can complete the closure of the drawer without further action of the user.

As the user pushes the drawer to close it and re-engage the self-close latch, the user must apply sufficient pushing force to overcome the spring force of the mechanism holding the self-close latch in the lockout position. When this happens, the latch pivots out of the lockout position and the spring will "unload" its kinetic energy into the self-close latch and pull the engaged catch latch and the drawer along a guided path to return it to its original closed position with a swift closing motion. From the user's perspective, however this can feel as if the drawer is being pulled from the user's hand. This too is typically not expected by the user and therefore can also be jarring from the user perspective and therefore negatively impact the user experience. Sometimes, in cases where a high spring force is needed to keep the drawer closed and maintain a sealing of the drawer in the closed position via relatively high closing force the catch latch of the drawer may bounce off the self-close latch without engaging and therefore the mechanism may not engage and close the drawer at all. Other times, the user may push the drawer closed but the closing mechanism will hang and not fully close. Refrigerators may include alarms for drawers that are not properly closed to prevent accidental defrosting and the like, but instances of the alarms going off due to issues with the closing mechanisms would be desirably avoided.

In view of the above, it would be desirable to provide a self-close drawer mechanism with reduced variation in opening and closing force required by the user to provide a more pleasant and intuitive user experience that avoids jerky motion of the drawer in the opening operation and a sudden acceleration of the drawer in the closing operation. Avoiding sudden and dramatic drop-off in pulling force required by the user in opening of the drawer, and also avoiding sudden and dramatic pulling force of the mechanism in the closing operation would also improve drawer reliability and enjoyment by the user. Specifically, it would be desirable to provide a self-close mechanism that operates with more uniform force when opening and closing the drawer in the active closing range, with as gentle transitions as possible, and maximizing the applied force at the point of full close in order to enhance sealing ability as much as possible. For the reasons above, known self-closing mechanisms are incapable of operating in the desired manner. The industry standard mechanism has therefore yet to completely meet the needs of the marketplace.

Exemplary embodiments of inventive self-close drawer mechanisms are described herein that meet longstanding and unfulfilled needs in the art by operating to produce a high initial max pull force in the drawer opening operation, then exhibit a gradually decreasing pull force as the mechanism is activated from an original, closed start position and dropping off to a pull force at the unlatched lockout position about equal to the rolling resistance force of the drawer. A smoother opening operation is therefore realized without the sudden and unexpected jerking motion of conventional mechanisms that required maximum pull force to be applied by the user near the end of the opening operation. Smoother closing operation is also provided without sudden acceleration of the drawer. Such operation is achieved via a rotating dual-cam force loading element defining two separate cam profiles and a spring-loaded flexible link system. The dual-cam force loading element has a larger cam profile and a smaller can profile each being pertinent to the respective opening and closing operation of the drawer.

In a contemplated embodiment, the smaller cam profile has a first flexible link element attached to the dual-cam force loading element at one end, with the first flexible link wrapping around the smaller cam profile and attaching at its other end to a spring. The smaller cam profile creates a mechanical advantage that is exerted through the first flexible link and into the spring to "load" it as the drawer is opened.

In a contemplated embodiment, the larger cam profile has a second flexible link element attached to the dual-cam loading element at one end, with the second flexible link wrapped around its profile and attaching at its other end to a sliding self-close latch. The larger cam profile creates a mechanical advantage as the dual-cam force element is rotated through the force transferred into the flexible link from the self-close latch moving from its initial, closed start position along its path of travel as the drawer is opened.

Together, the smaller and larger cam profiles in the dual-cam force loading element realize a desirable force curve by reducing spring force in the opening operation while increasing stored potential kinetic energy of the spring in the closing operation. The larger cam profile reduces the pulling force required by the user as the drawer is opened to unlatch the mechanism while the smaller cam loads the spring element in the opening operation of the drawer. When the drawer is closed and the mechanism is reactivated, larger cam profile in turn applies a reduced pulling force at the beginning of the closing operation culminating in a higher closing force toward the end of the closing operation.

The inventive self-close drawer mechanisms will now be explained in relation to exemplary embodiments illustrated in the figures. While the following description is made in the exemplary context of a refrigeration drawer, it is understood that the concepts described herein could equally be applied to appliances other than refrigerators. The concepts described herein may also be applied to kitchen and bath cabinetry in general, as well as furniture items such as desks, dressers, dining room buffets and hutches, end tables or any other application wherein self-closing drawer features are desired. The refrigeration example described herein is therefore set forth for illustration rather than limitation. Also, method aspects will be in part explicitly discussed and in part apparent from the following description and the accompanying drawings.

Figure 1:
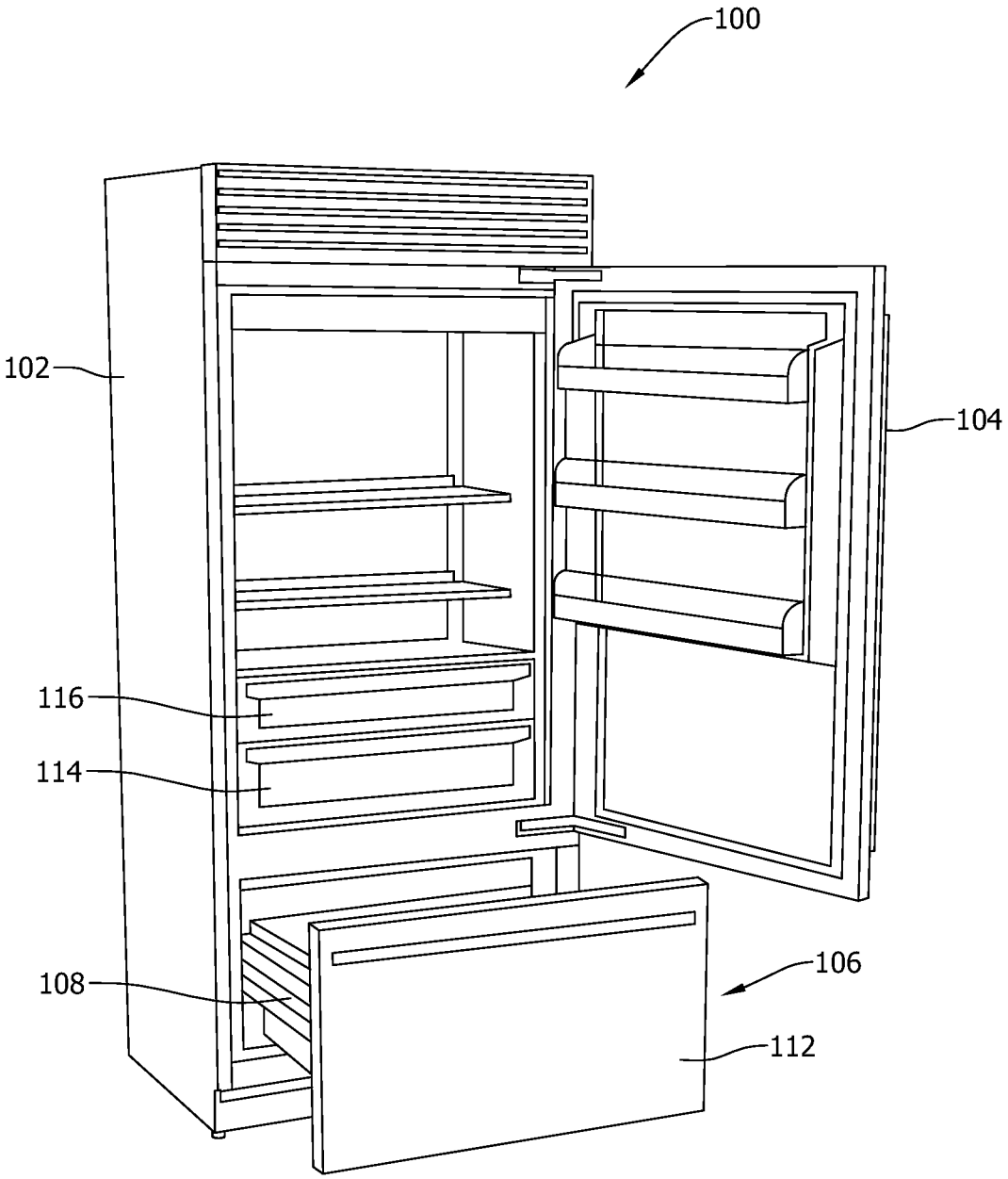
FIG. 1 is perspective view of an exemplary appliance including a self-closing drawer.

FIG. 1 is perspective view of an exemplary appliance 100 in the form of a refrigerator including a cabinet 102, a rotating refrigerator door 104 and a bottom mount freezer drawer 106. The freezer drawer 106 includes two side brackets 108 each including a catch release 110 (FIG. 2) fabricated from a known metal or plastic material, and a front cover or door 112 with a handle for a user to pull to open the drawer 106 or to push the drawer 106 closed. As the drawer 106 is pulled and pushed it is slidably movable away from the cabinet 102 to provide user access the contents of the drawer 106 or slidably movable back toward the cabinet 102 wherein the user cannot access the contents of the drawer 106. The drawer 106 may include slides including wheeled slides or rails or ball-bearings allowing the drawer 106 to glide open or closed along a guided path. As such slides, rails and bearings are known and appreciated by those in the art further description thereof herein is omitted.

In the example shown in FIG. 1 the refrigerator 100 also includes internal drawers 112, 114 in the refrigeration compartment behind the door 104. When the door 104 is opened as shown, the internal drawers 112, 114 are accessible to the user, and the internal drawers may likewise be slidably opened and closed to access the contents of the drawers or store the contents in the refrigerator when the door 104 is closed. The self-closing mechanism 120 shown and described next in relation to FIGS. 2-13 is illustrated in the following drawings for the external bottom mount drawer 106 but the self-close mechanism 120 could likewise be used on the internal drawers 112 and 114 in a similar manner if desired. Except for the self-closing mechanism 120, the construction of the drawers 106, 112, 114 as well as the appliance 100 in terms of materials and process is well known and further details thereof will therefore be omitted herein.

In the case of the refrigerator appliance 100, self-closing mechanisms for internal and external drawers have particular benefits that improve the user experience, as well as the performance and reliability of the appliance 100. Specifically the self-closing mechanism 120 prevents inadvertent drawer opening by requiring a certain amount of force to open the drawer 106 by a user and as such when the drawer 106 is closed it remains closed to reliably keep the freezer compartment cool and keep the food contained therein fresh. The self-closing mechanism 120 likewise prevents an inadvertent failure by the user to completely close the drawer 106, and enhances the sealing of the drawer 106 when closed by automatically applying and maintaining a predetermined degree of closing force. Accordingly, aside from a luxurious user experience, the self-close refrigeration drawer 106 contributes to a reduced energy consumption of the applicant 100 via securely maintaining the drawer 106 in a desired closed position, avoids an inadvertent freezer defrosting and cleanup due to incomplete closure of the drawer 106, and reduces occurrence of unpleasant food spoilage and expense to replace spoiled food that an incompletely closed drawer 106 that can otherwise occur.

It is contemplated that the self-closing drawer mechanisms described next could also be applied to a variety of other types of refrigerator configurations besides that specifically illustrated and that have additional drawers or drawers in locations other than that shown in FIG. 1. Additionally, drawers in appliances other than refrigerators such as, for example only, oven drawers may also be equipped with the self-close mechanism 120 to desirably provide enhanced oven operation and energy efficiency with effective sealing. Likewise, the self-closing mechanisms described herein could be generally applied to non-appliances such as kitchen and bath cabinetry, closet organizer and storage systems. The self-close mechanism may also be desirably used in applications that do not involve a cabinet but instead have another support structure for mounting of the drawer, such as host of furniture items having drawers wherein self-closing features are desirably provided. In all cases, unsightliness and hazards presented by incompletely closed drawers are avoided by the self-close mechanism 120 and an improved user experience is provided.

FIGS. 2-5 are various views of an exemplary self-closing drawer assembly for the drawer 106 in the appliance 100 (FIG. 1). The self-closing mechanism is shown in these figures in a fully latched position maintaining the drawer 106 in the closed position with a predetermined amount of closing force.

Figure 2:
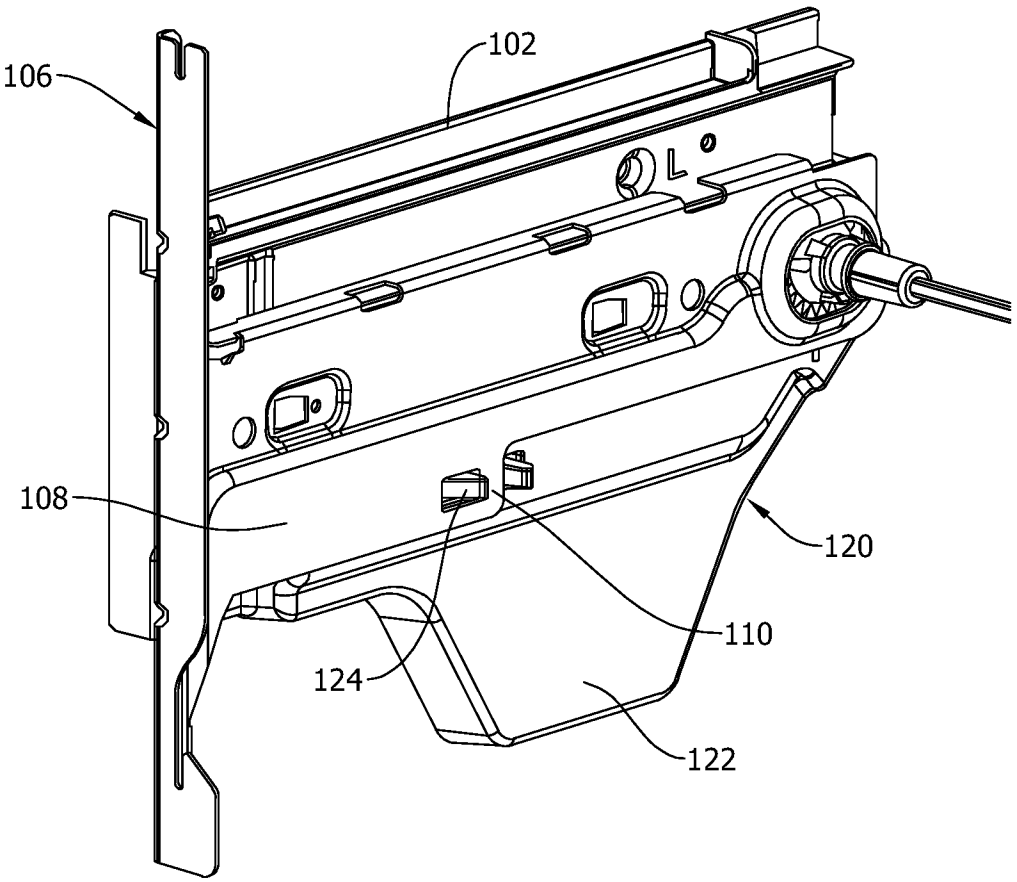
FIG. 2 is a partial front view of an exemplary self-closing drawer assembly for the appliance shown in FIG. 1 in a latched and closed position.

FIG. 2 is a front view of the drawer assembly including the integrated self-close mechanism 120 including a housing 122 attached to the cabinet 102 and the mechanism 120 interfaced with the catch latch 110 of the side bracket 108 for the drawer 106. The catch latch 110 of the drawer 106 is engaged with a sliding self-close latch 124 of the mechanism 120. FIG. 2 shows the self-close mechanism 120 for the left hand-side of the drawer 106 shown in FIG. 1, whereas the right-hand side of the drawer 106 would also be interfaced with a self-close mechanism 120.

Figure 3:
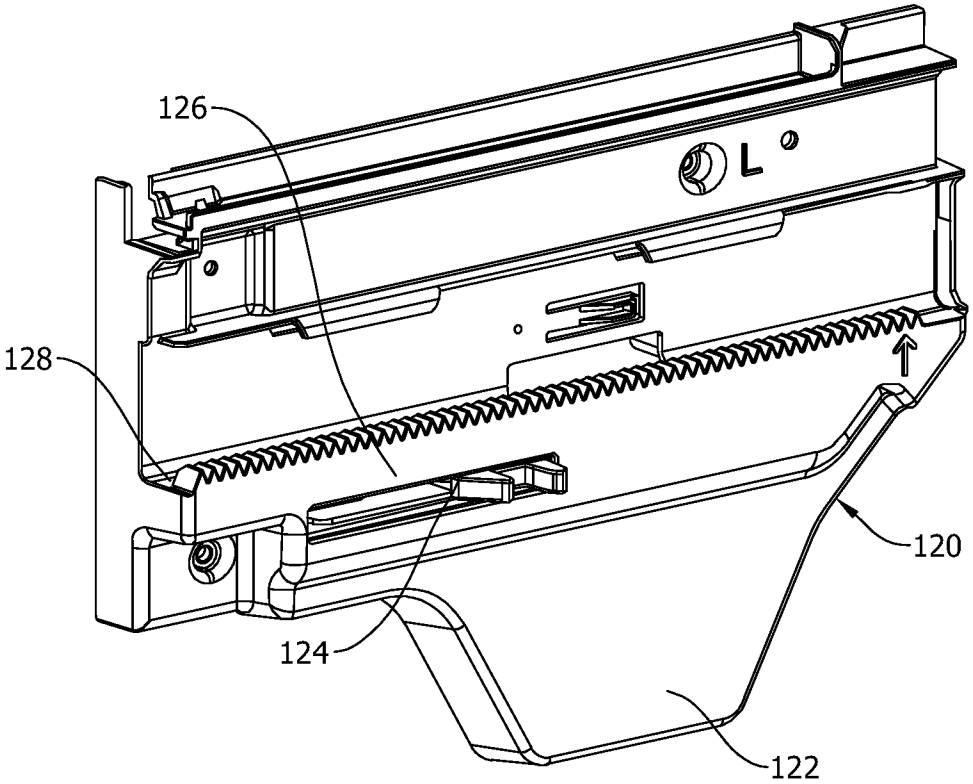
FIG. 3 is a front view of an exemplary integrated self-close mechanism for the assembly shown in FIG. 2 in the latched and closed position.

FIG. 3 is a front view of the exemplary integrated self-close mechanism 102 with the drawer side bracket 108 and catch latch 110 removed. The housing 102 of the mechanism 120 includes a guide slot 126 from which the sliding self-close latch 124 protrudes. The guide slot 126 defines an elongated and linearly extending path for the self-close latch 124 to move between latched and unlatched positions. A drawer glide path 128 extends above and is spaced from the guide slot 126 and receives a wheeled slide/rail or ball bearings to facilitate movement of the drawer side 108 (FIG. 2) relative to the housing 122 and the cabinet 102. The self-close latch 124 is shown in FIG. 3 at the rear end of the guide slot 126 which corresponds to the fully latched position of the mechanism 120 and the fully closed position of the drawer 106.

Figure 4:
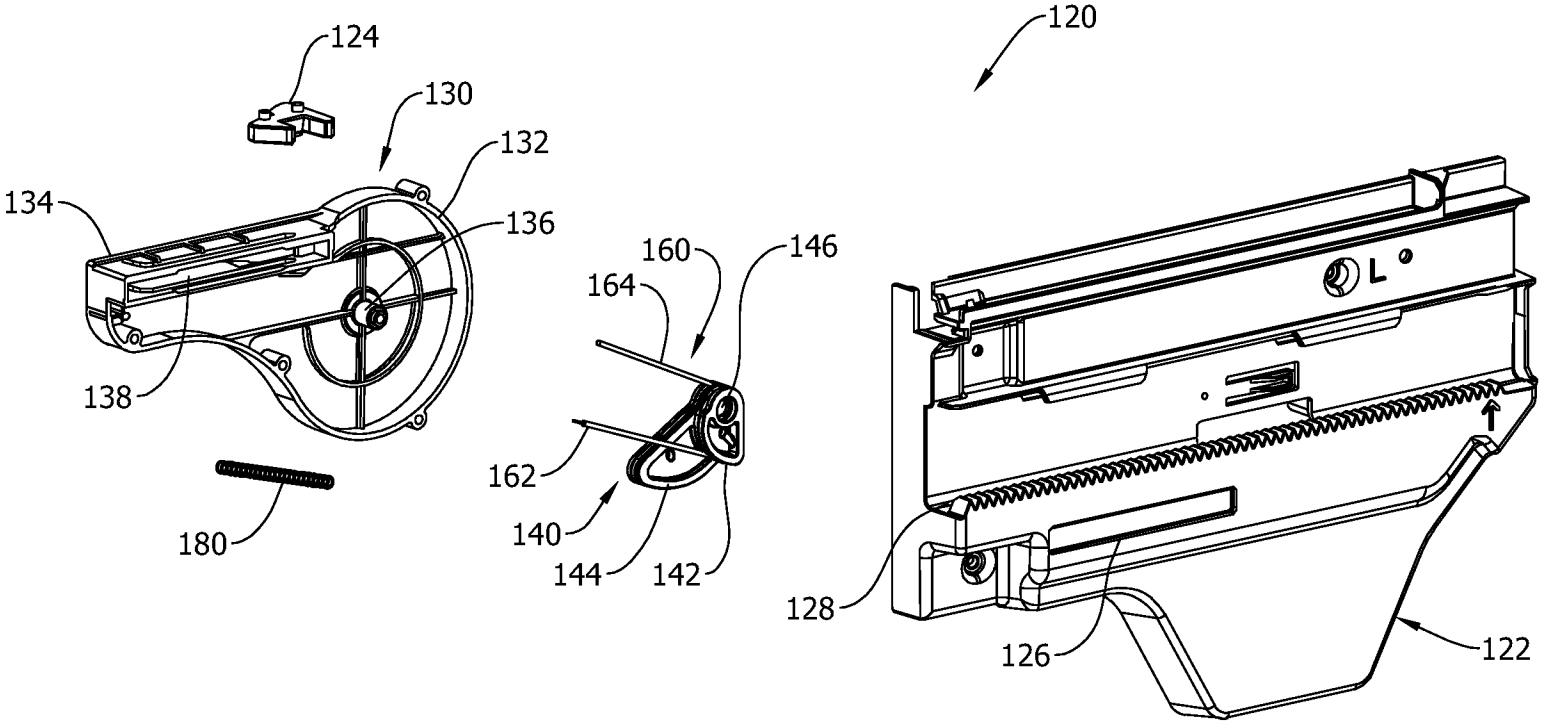
FIG. 4 is an exploded view of the integrated self-close mechanism shown in FIG. 3.

FIG. 4 is an exploded view of the integrated self-close mechanism 120 including the front housing 122 formed with the guide slot 126 and the drawer glide path 128. A rear housing 130 is coupled to the front housing 122 and captures the self-close latch 124, a rotating dual-cam force loading element 140, a flexible link system 160 and a coil spring 180 therebetween.

The front and rear housings 122, 130 may be formed and fabricated from known heavy duty plastic materials in an exemplary embodiment, although in other embodiments other suitable materials for the housings 122, 130 may be employed, including but not limited to metallic materials. The rear housing 130 is formed with a round section 132 and an elongated latch section 134. The round section 132 receives the rotating dual-cam force loading element 140 via a cylindrical peg 136 that serves as an axle about which the rotating dual-cam loading force element 140 can rotate. The latch section 134 includes a guide slot 138 that receives the self-close latch 124. When assembled, the self-close latch 124 extends in the slot 138 in the housing 130 and the self-close latch 124 protrudes through the front housing 122 in the slot 126 as shown in FIG. 3.

The self-close latch 124 in the example shown is shaped with two engagement prongs and an opening therebetween. The self-close latch 124 may be formed and fabricated from a heavy duty plastic material or another suitable material known in the art including metallic material according to known techniques. When the drawer catch latch 110 is received in the opening between the prongs in the self-close latch 124, the catch latch 110 engages one of the prongs as the drawer 106 is moved in a first direction to open the drawer 106 and engages the other of the prongs as the drawer 106 is moved in a second direction opposite to the first direction to close the drawer 106. While a specific shape and geometry of the self-close latch is shown in the exemplary figures, variations are of course possible.

The rotating dual-cam force loading element 140 is formed from a heavy duty plastic material or metallic material according to known processes, and in the example shown includes a first or smaller cam surface 142 and an integral second or larger cam surface 144 that collectively rotate about a common bore or opening 146 on one end of the dual-cam force loading element 140. The opening 146 received on and is secured to the peg 136 of the rear housing 130. A flexible link system 160 including a first and second flexible link elements 162, 164 is wrapped around each of the respective cam surfaces 142, 144. Each flexible link 162, 164 is an elongate element exhibiting longitudinal flexibility to conform (or not) to the cam surfaces 142, 144 in use while avoiding any stretching thereof in use. Contemplated flexible links include cables, cords, ropes or other equivalent elements, which may be fabricated from any suitable material including metallic and non-metallic materials having sufficient strength to function in the manner described herein.

In the example shown, each cam surface 142, 144 in the dual-cam force loading element 140 generally includes a cam profile with an arcuate section and a flat or straight section opposing the arcuate section. The cam profiles of each cam surface 142, 144 are generally similar to one another, with a radius of curvature of the arcuate section in the smaller cam surface 142 being smaller than the radius of curvature for the larger cam surface 144, and with the flat section in the smaller cam surface 142 being shorter than the flat section in the larger cam surface 144. As such, a circumference of the smaller cam surface 142 is smaller than a circumference of the larger cam surface 144. The flat sections in each of the cam surfaces 142, 144 extend radially when the dual-cam force element 140 is mounted to the rear housing 130, and the flat sections in each cam surface extend at a 90° angle from one another as shown. The specific shape and cam profiles 142, 144 in the example shown realize the desired pull force characteristics desired further below, although it is appreciated that variations in shape and orientation of the cam profiles 142, 144 are possible to realize a different, but also desirable pull force characteristic. Likewise, in contemplated embodiments, a third cam surface could be provided to produce additional, but still desirable variation in the resultant pull force characteristic produced in the mechanism 120.

Figure 5:
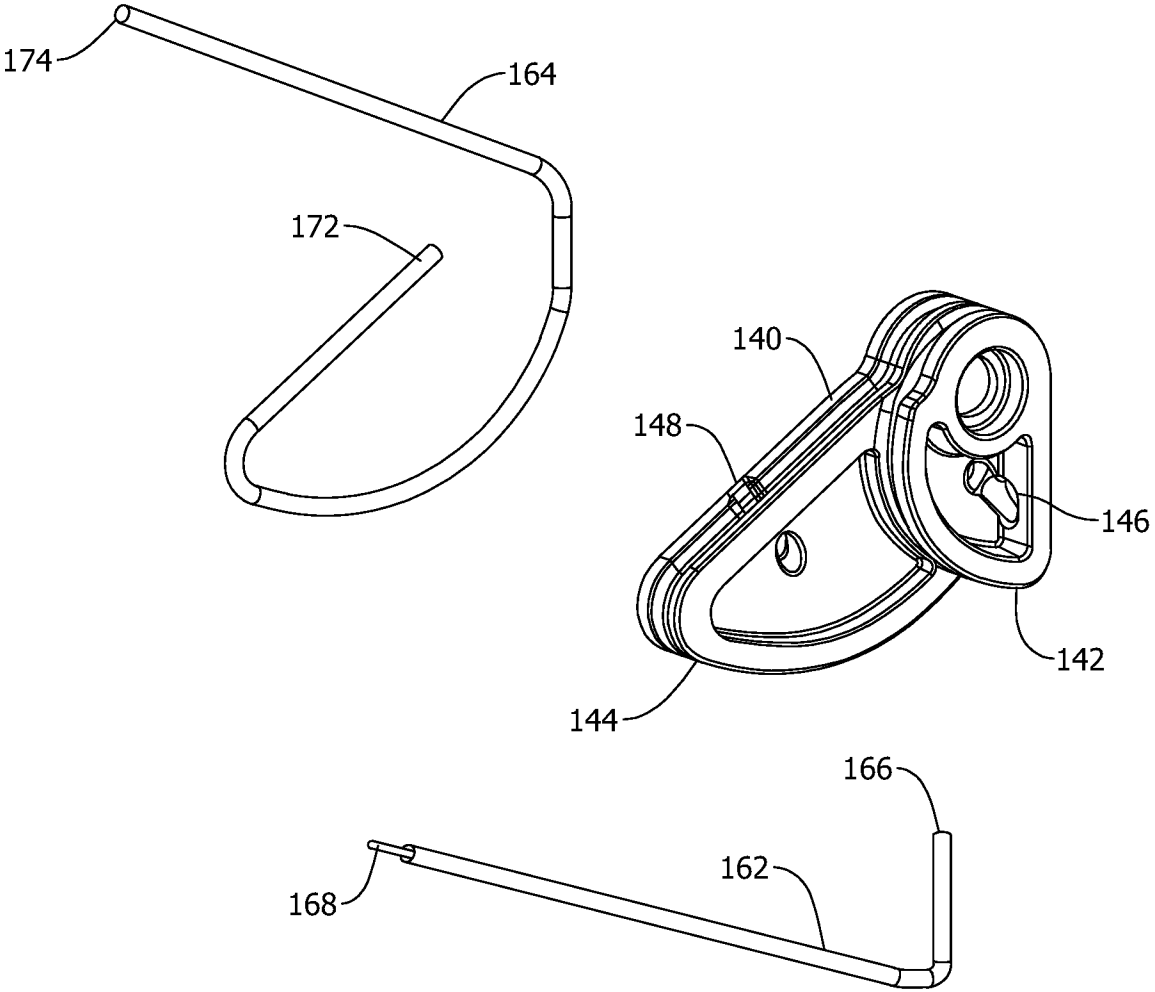
FIG. 5 illustrates an exploded view of a dual-cam loading element and spring sub-system of the mechanism shown in FIGS. 3 and 4.
Figure 6:
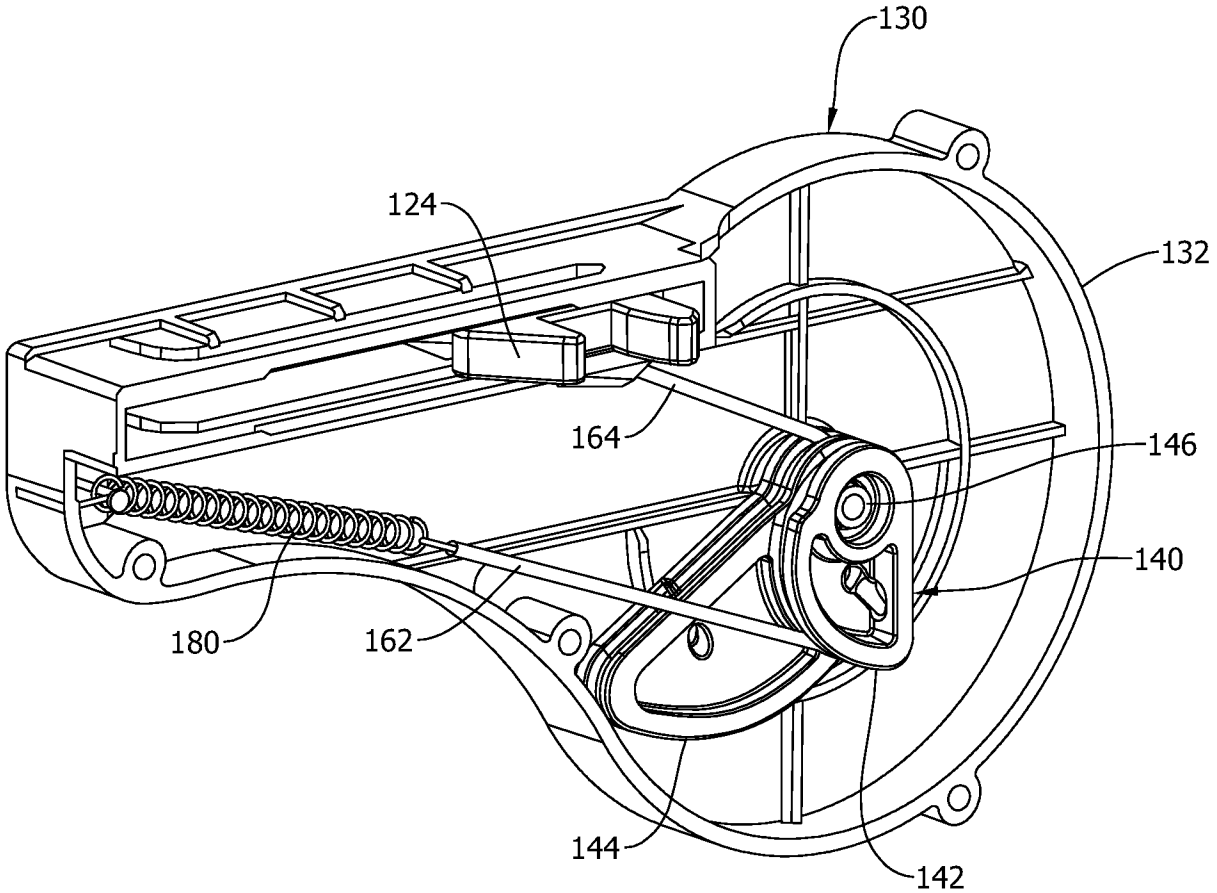
FIG. 6 is a partial assembly view of a portion the integrated self-close mechanism shown in FIG. 4 in the latched and closed position.

FIG. 5 illustrates an exploded view of the dual-cam loading element 140 and flexible link system 160 of the mechanism 120. FIG. 6 is an assembly of the dual-cam loading element 140 and flexible link system 160 of the mechanism 120 installed in the rear housing 130.

As shown in FIGS. 5 and 6, the smaller cam surface 142 of the dual-cam loading element 140 receives a first flexible link 162 attached to the dual-cam loading element at one end 166, with the first flexible link 162 wrapping around the smaller cam profile and attaching at its other end 168 to the spring 180 (FIG. 4) at one end of the spring 180. The opposing end of the spring 180 is attached in turn to the latch section 134 of the rear housing 132. The smaller cam surface 142 includes a hole 146 receiving the flexible link end 156 and being secured thereto. In operation of the mechanism 120, the smaller cam profile 142 creates a mechanical advantage that is exerted through the flexible link 162 and into the spring 180 to "load" it with stored kinetic energy.

The larger cam profile 144 of the dual-cam loading element 140 has a second flexible link 164 attached to the dual-cam loading element at one end 172, with the second flexible link 164 wrapped around its cam profile and attaching at its other end 174 to the self-close latch 124. In the operation of the mechanism 120, the larger cam profile 144 creates a mechanical advantage through the force transferred into the flexible link 164 from the self-close latch 124 moving from its initial, closed start position along its path of travel.

Together, the smaller and larger cam surfaces 142, 144 and corresponding cam profiles in the orientation shown in the dual-cam loading element 140 realize an optimal force curve by reducing spring force experienced by the user in the opening operation of the drawer 106 while increasing stored potential kinetic energy of the spring 180 in the closing operation of the drawer 106. The optimal force curve initially exhibits a high initial max pull force in the drawer opening operation, then exhibits a gradually decreasing pull force as the mechanism is activated from an original, closed start position and dropping off to a pull force about equal to the rolling resistance of the drawer past the point where the self-close latch reaches the lockout position. A smoother opening operation is realized without a sudden and unexpected jerking motion of conventional mechanisms that require maximum pull force to be applied by the user near the end of the opening operation.

In the latched position shown in FIG. 5, the spring 180 is loaded in tension via the flexible link 162 and the smaller cam profile 142 to produce a closing force on the drawer 106 to maintain the drawer 106 in the closed position and ensure a desired amount of sealing of the drawer 106 in the closed position to ensure optimal operation of the appliance 100.

Figure 7:
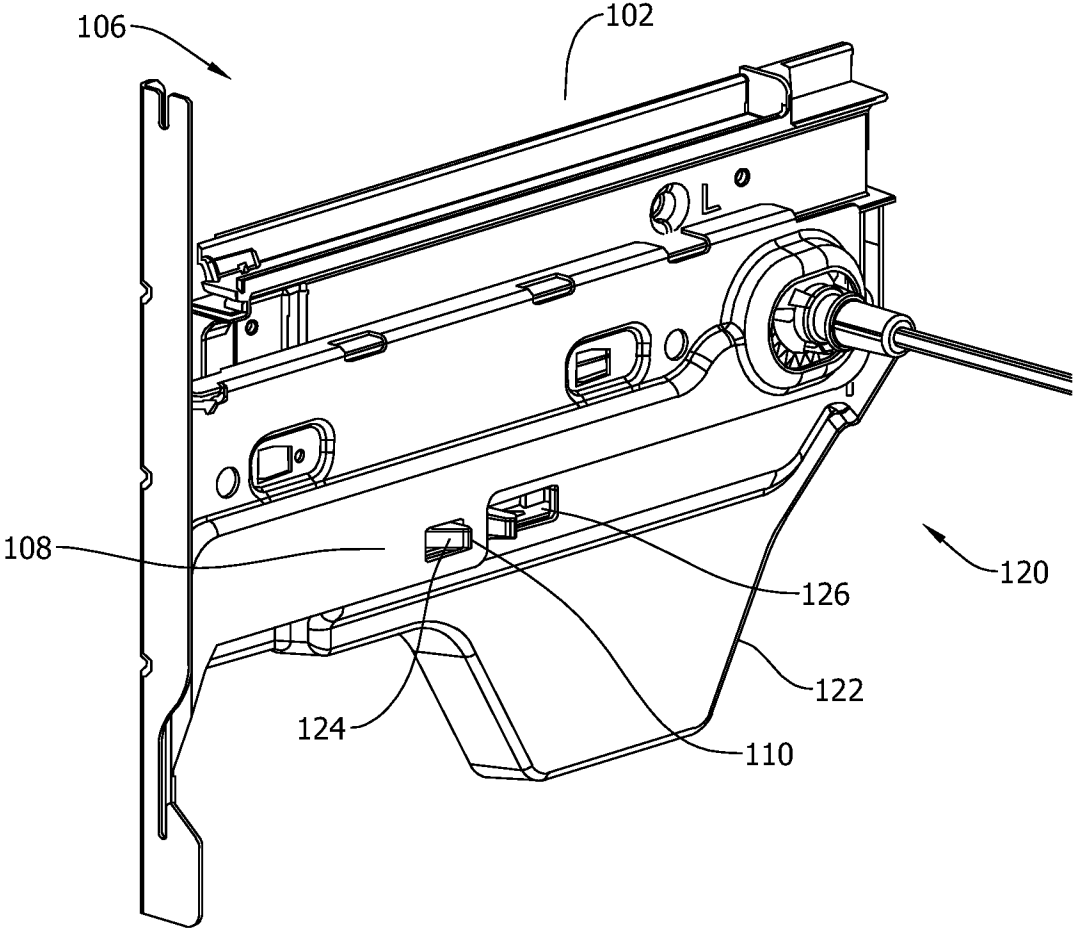
FIG. 7 is a partial front view of the self-closing drawer assembly shown in FIG. 2 in an intermediate position.
Figure 8:
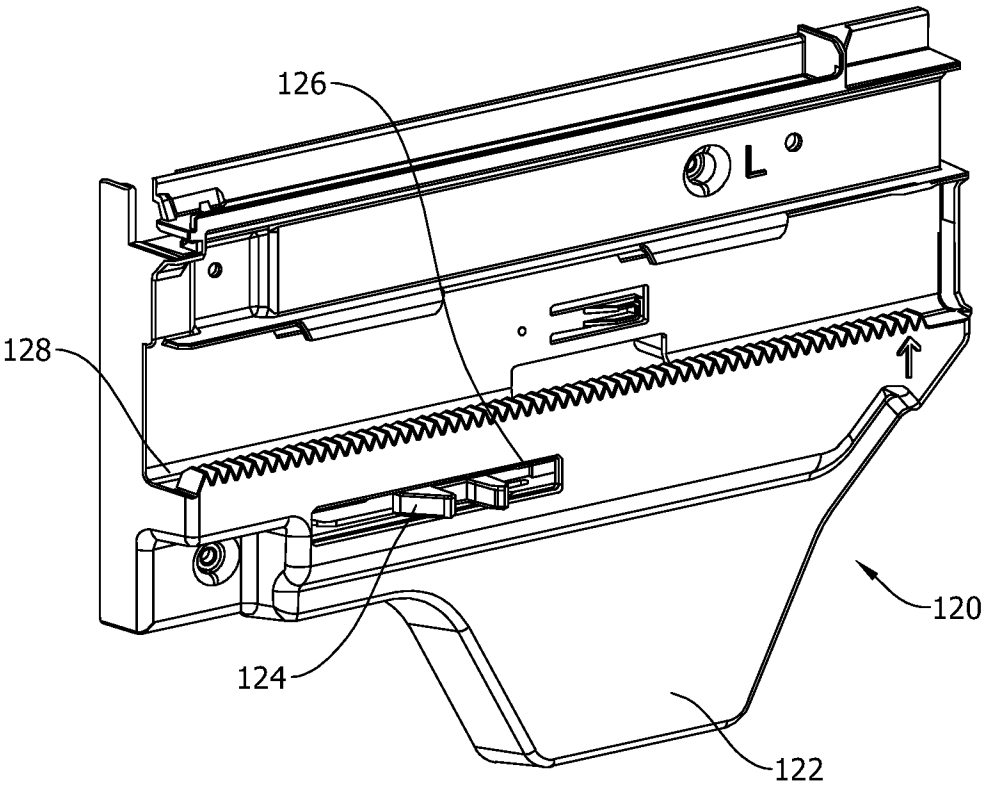
FIG. 8 is a front view of the integrated self-close mechanism shown in FIG. 3 in the intermediate position.
Figure 9:
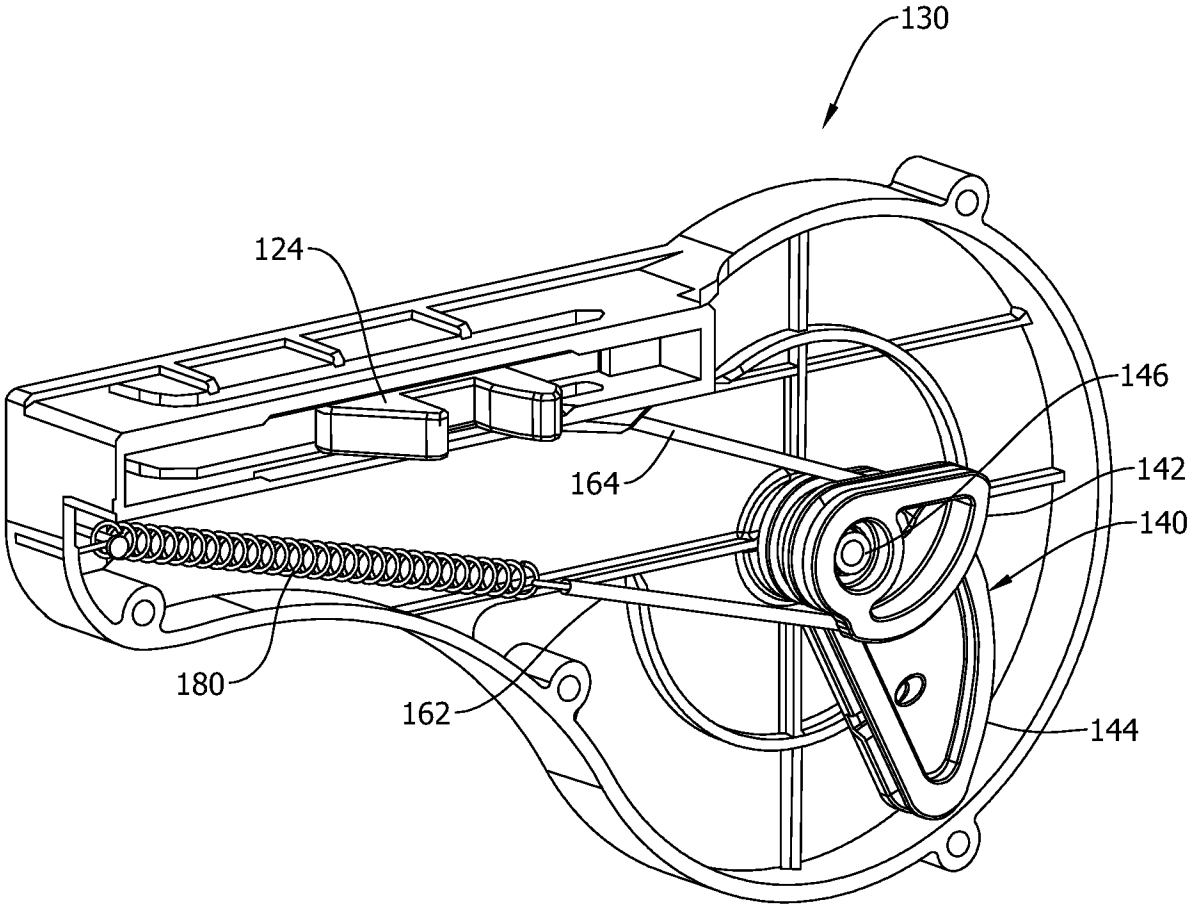
FIG. 9 is a partial assembly view of a portion of the integrated self-close mechanism shown in FIG. 6 in the intermediate position.

FIGS. 7-9 are various views of the self-close mechanism 120 in an intermediate position as the drawer 106 is pulled open by a user. The catch latch 110 of the drawer 106 remains engaged to the self-close latch 124 and the self-close latch is pulled along the slots 126, 138. As seen in FIG. 9, the dual-cam loading element 140 has rotated counter-clockwise more than 90° from the fully closed and latch position shown in FIG. 6. The second flexible link 164 attached to the self-close latch 124 on the second cam profile 144 rotates the dual-cam loading element 140, while the first flexible link 162 on the smaller cam profile 142 stretches the spring 180 and loads it with additional stored force. As the dual-cam loading element 140 rotates, the flexible link 164 unwraps from the larger cam surface 144, while the flexible link is further wrapped on the smaller cam surface 142. The length of the flexible member that extends from the dual-cam loading element 180 is increased while the length of the flexible member that extends from the smaller cam profile 142 is increased.

Because of the larger cam profile 144 in the dual-cam loading element 140 that is attached to the flexible link 164, as the drawer catch latch 110 pulls the self-close latch 124 along the guide path a longer moment arm and mechanical leverage is generated in the mechanism to stretch and load the spring 180 via the smaller cam surface 142 and the first flexible element 162 without the user experiencing an increasing pull force to open the drawer further. Instead, the user actually experiences a gradually reduced pull force being needed to continue to open the drawer 106.

Figure 10:
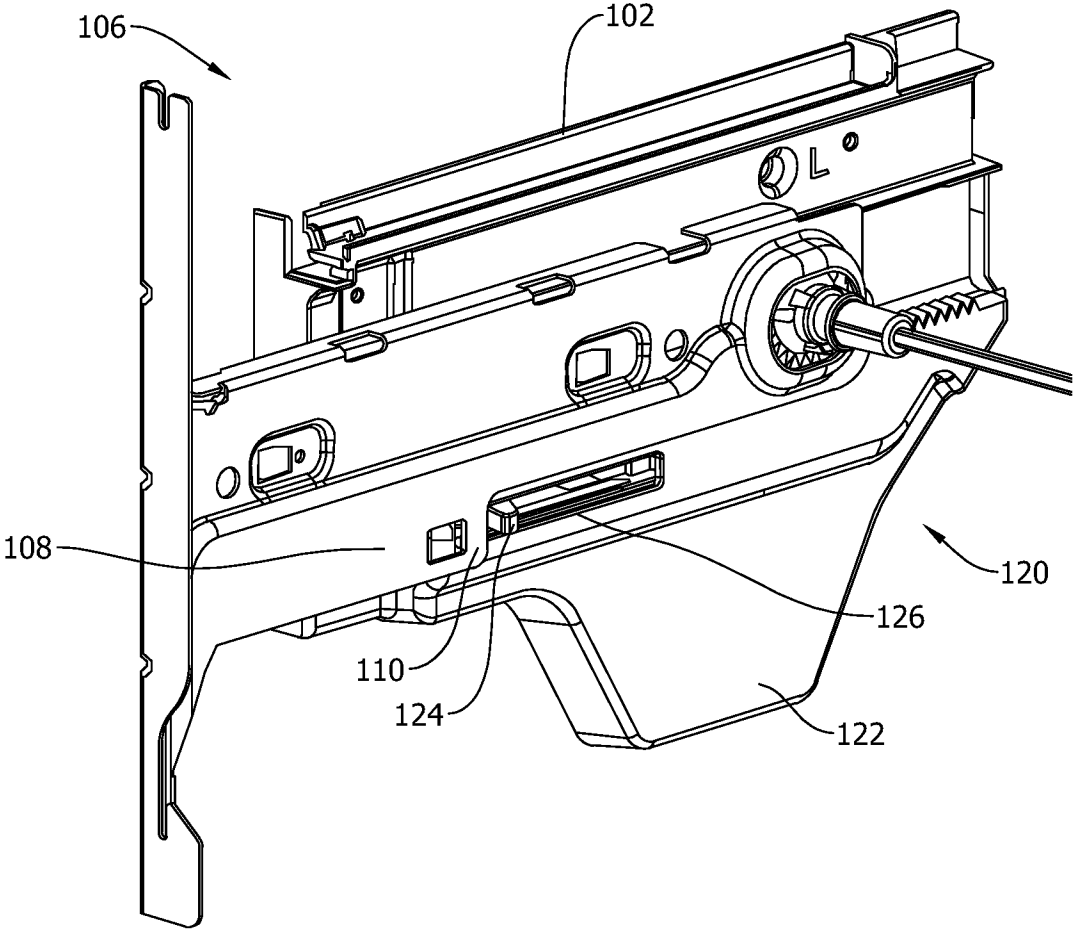
FIG. 10 is a partial front view of the self-closing drawer assembly shown in FIGS. 2 and 7 in an unlatched position.
Figure 11:
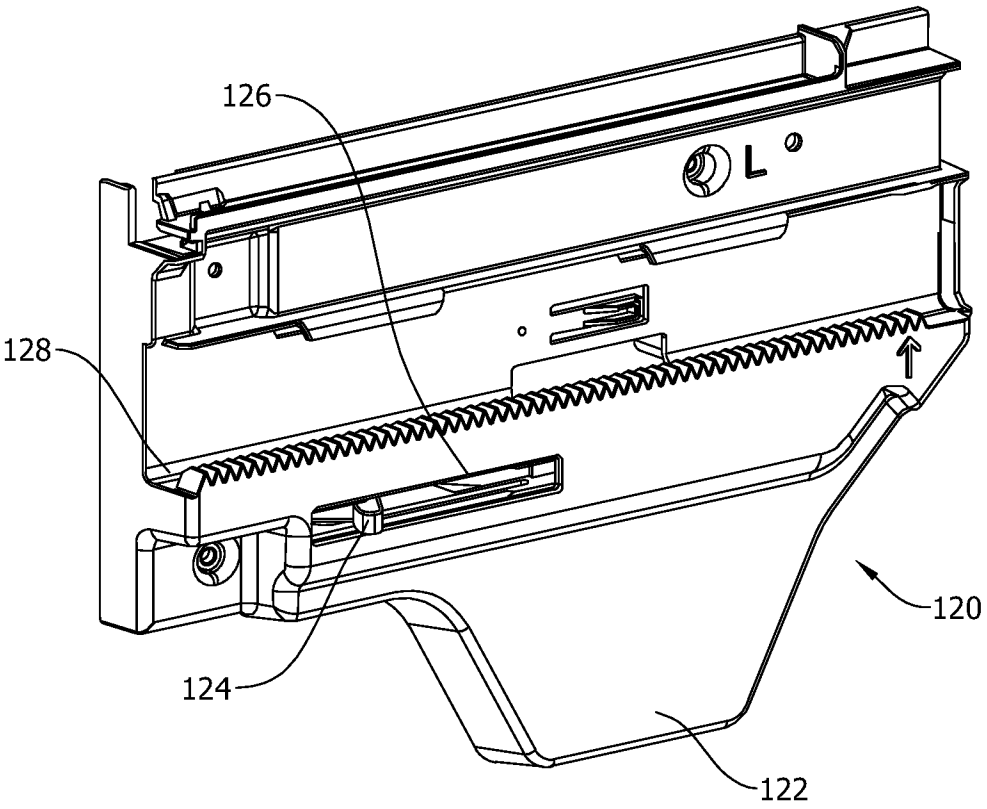
FIG. 11 is a front view of the integrated self-close mechanism shown in FIGS. 3 and 8 in the unlatched position.
Figure 12:
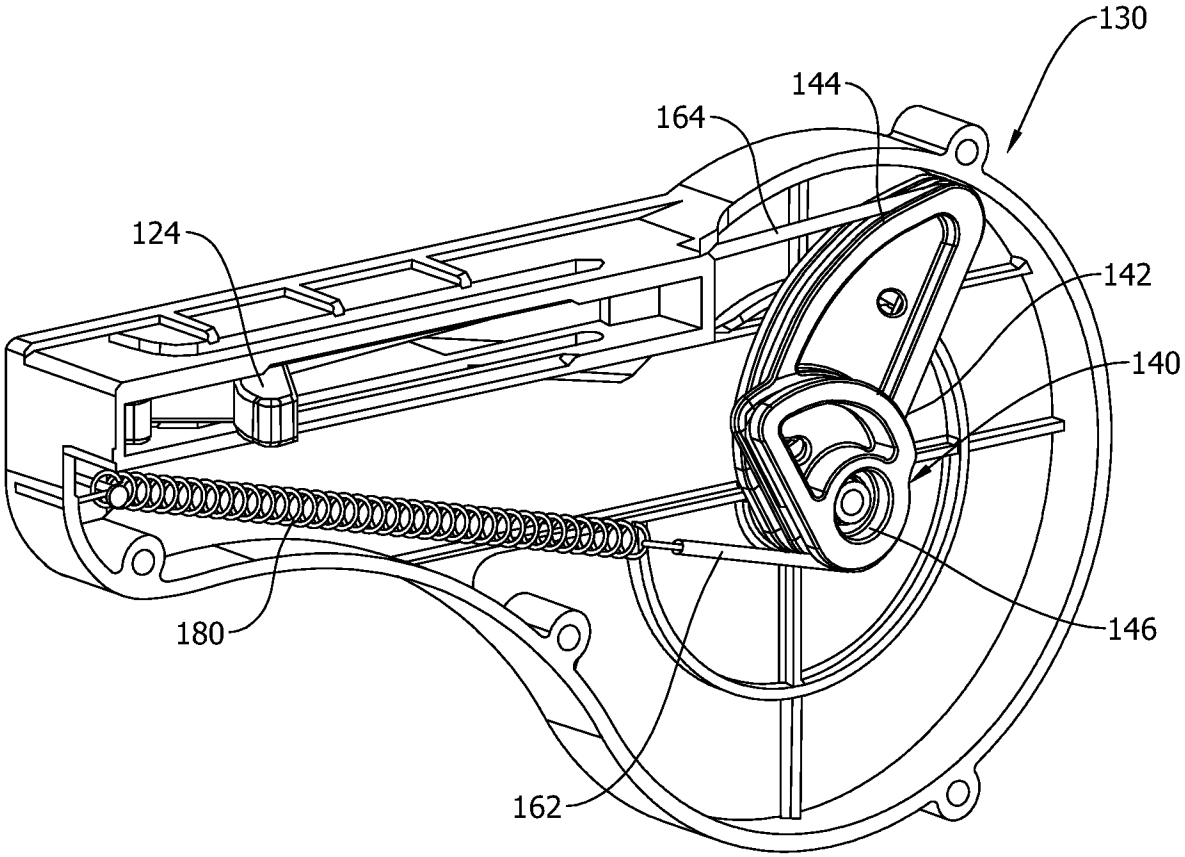
FIG. 12 is a partial assembly view of the integrated self-close mechanism shown in FIGS. 6 and 9 in the unlatched position.

FIGS. 10-12 are various views of the self-close mechanism 120 in an unlatched position. As seen in FIG. 12, the dual-cam loading element 140 has further has further rotated counter-clockwise more than 90° from the intermediate position shown in FIG. 6 as the first flexible link has been pulled further by the self-close latch 124. The first flexible link 162 has further wrapped around the first cam surface 142 and stretched and loaded the spring 180 even more, and the second flexible link has further unwrapped from the second cam surface 144. The self-close latch 124 has rotated away at the near end of the slots 126, 138 and the catch latch 110 of the drawer 106 is disengaged from the self-close latch 124. The spring 180 holds the catch latch in the lockout position disengaged from the drawer catch latch.

As before, because of the larger cam profile 144 in the dual-cam loading element 140 that is attached to the flexible link 164, a larger moment arm and increased mechanical leverage in the mechanism realizes still further pulling force reduction for the user to approach the unlatched position of the drawer as the drawer catch latch 110 pulls the self-close latch 124 to its final position rotated away from the drawer catch latch 110. The dual cam surfaces in combination and wrapping and unwrapping of the flexible link elements cause the required pulling force generated by the mechanism to fall to zero as the unlatched position is reached. Once the mechanism in unlatched, the drawer is feely movable by the user to its fully opened position with a pull force about equal to the rolling resistance of the drawer.

The self-close mechanism 120 shown and described realizes the following force curve set forth in Table 1 below and illustrated in FIG. 13.

TABLE 1

| Drawer Position | Drawer Travel Distance | Pull Force |
|---|---|---|
| P1 | 0 mm | 14.4 lbf |
| P2 | 10 mm | 17.6 lbf |
| P3 | 50 mm | 10 lbf |
| P4 | 85 mm | 0 lbf |

Figure 13:
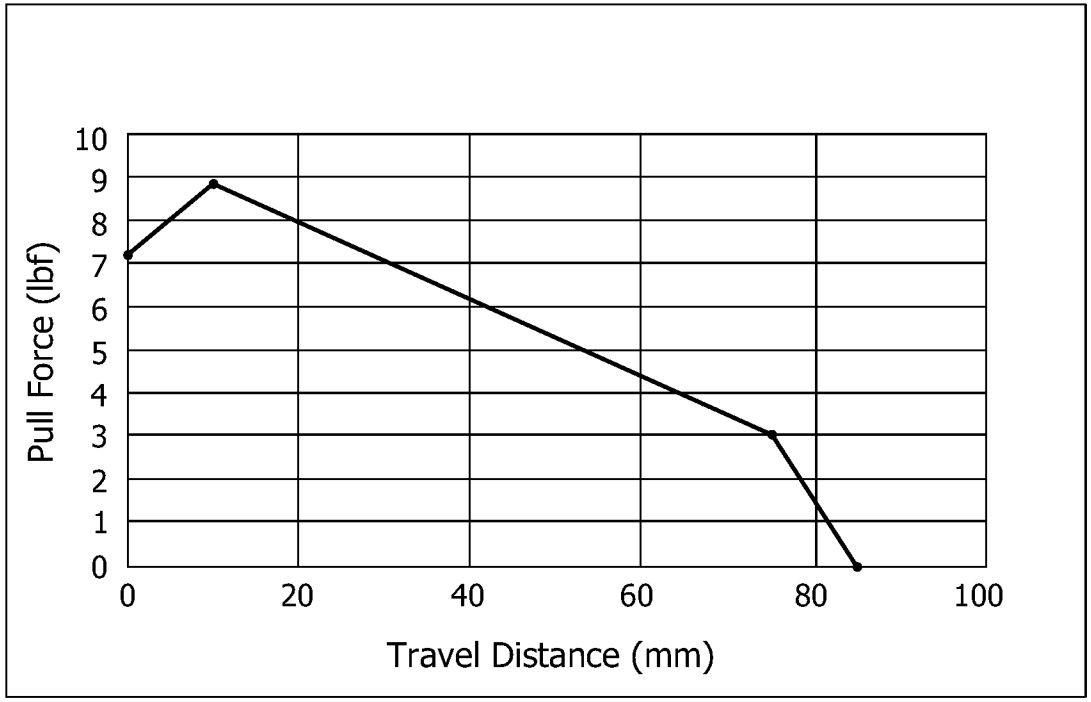
FIG. 13 is an exemplary force versus distance chart for the self-close drawer mechanism shown in FIGS. 2-12.

Relative to the conventional force curve of a conventional self-close mechanism shown and described in relation to FIG. 14, the force curve shown in Table 1 and FIG. 13 for the self-close mechanism 120 is considerably easier for the user to operate, and generally avoids an unexpected or unintended sudden jerk or sudden acceleration of the drawer that can detract from the user experience. As seen in FIG. 13, the pull force quickly ramps up between points P1 and P2 at a uniform rate, and then ramps down more gradually but still at a uniform rate between points P2 and P3, and then drops to zero but at a uniform rate between points P3 and P4. The pull force in FIG. 13 therefore exhibits gentler transitions and smoother operation with a substantially reduced amount of force required to open the drawer than the conventional mechanism pull force shown in FIG. 14. As mentioned above, alternative force curves in the mechanism 120, but still improved relative to the conventional pull force of a conventional mechanism shown in FIG. 14, may be realized with varying sizes and shapes of the cam surfaces 142, 144 in the mechanism 120. The travel distances shown in FIG. 13 between the points described are exemplary only and may be increased or decreased in other embodiments. In contemplated embodiments, a 60% to 100% reduction of force through the range of motion of the drawer is preferred to provide a pleasing pull force to the user in the opening and closing of the drawer.

In the unlatched position shown in FIG. 12, the spring 180 in the mechanism 120 is now fully loaded with maximum stored energy to re-close the drawer 106. The spring 180 with maximum stored energy further maintains the drawer catch latch 110 in the lockout position as shown in FIGS. 10-12 being disengaged from the self-close latch 124. The self-close mechanism 120 will not operate to re-close the drawer 106 until the user pushes the drawer 106 back toward the cabinet with sufficient force to cause the drawer catch latch 110 to re-engage the self-close latch 124, causing the self-close latch 124 to pivot back to its original position wherein the mechanism 120 can apply the stored force to pull the drawer catch latch 110 back through the intermediate position shown in FIGS. 7-9 and to the latched position shown in FIGS. 2-6 wherein the drawer 106 is fully closed with a predetermined amount of closing force to keep the drawer closed until a user again applies sufficient pulling force to overcome it.

The wrapping and unwrapping of the flexible link elements 162, 164 on the cam surfaces 142, 144 occurs in reverse in the closing operation and the pulling force shown in FIG. 13 operates in reverse to initially pull the drawer closed with a smaller force between points P4 and P3, that increases as the door is closed between points P3 and P2, culminating in a reduced but adequate closing force at P1 to effectively seal the drawer 106. The smaller initial pull force in the closing operation avoids the sudden acceleration of the drawer that a conventional mechanism produces, and reduces any likelihood that the mechanism may not re-engage. The mechanism 120 may therefore be engaged in a much gentler manner by the user with an improved user experience.

The benefits and advantages of the inventive concepts disclosed are not believed to have been amply illustrated in view of the exemplary embodiments disclosed.

An embodiment of a self-close drawer mechanism has been disclosed including a housing, a slidable self-close latch selectively positionable within the housing, a rotatable cam element in the housing, a flexible link extending around the cam element, and a spring applying stored force to the sliding self-close latch through the flexible link.

Optionally, the rotatable cam element includes integrally formed first and second cam surfaces of similar shape but different size. The flexible link may include a first flexible link attached to the first cam surface at a first end thereof and wrapping around the first cam surface, the first flexible link further attaching to an end of the spring at a second end thereof. The flexible link may also include a second flexible link attached to the second cam surface at a first end thereof and wrapping around the second cam surface, the second flexible link further attaching to the slidable self-close latch at a second end thereof.

As further options, the second cam surface may be larger than the first cam surface. Each of the first and second cam surfaces may include an arcuate section and a flat section opposing the arcuate section. The self-close drawer mechanism may be provided in combination with a drawer.

An embodiment of a self-close drawer mechanism has also been disclosed including a housing, a slidable self-close latch selectively positionable within the housing along a guided path, a rotating dual-cam force loading element in the housing, first and second flexible links extending around the rotating dual-cam force loading element; and a spring attached to the first flexible link. The second flexible link is attached to the self-close latch, wherein the spring applies stored force to the sliding self-close latch through the first and second flexible links with a gradually reducing pulling force as the self-close drawer mechanism is unlatched.

Optionally, the rotating dual-cam force loading element includes an integrally formed first and second cam surfaces of similar shape but different size. The first and second flexible links may each be attached to the respective first and second cam surfaces. The second cam surface may be larger than the first cam surface. Each of the first and second cam surfaces may each include an arcuate section and a flat section opposing the arcuate section. The self-close drawer mechanism may be provided in combination with a cabinet. The cabinet may be an appliance cabinet. The appliance may be a refrigerator.

An embodiment of a self-closing drawer assembly has also been disclosed including a drawer having a catch latch, and an integrated self-close assembly interfacing with the catch latch. The integrated self-close assembly includes a housing, a slidable self-close latch selectively positionable within the housing along a guided path by the catch latch in an opening operation of the drawer, a rotatable dual-cam force loading element in the housing, first and second flexible links extending around the rotatable dual-cam force loading element, and a spring attached to the first flexible link. The second flexible link is attached to the self-close latch, wherein the spring applies stored force to the sliding self-close latch through the first and second flexible links with a gradually reduced pulling force as the self-close assembly is unlatched in the opening operation.

Optionally, the rotatable dual-cam force loading element may include integrally formed first and second cam surfaces of similar shape but different size. The first and second flexible links may each be attached to the respective first and second cam surfaces. The second cam surface may be larger than the first cam surface. Each of the first and second cam surfaces may include an arcuate section and a flat section opposing the arcuate section. The drawer may be a refrigeration drawer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A self-close drawer mechanism comprising:

a housing;

a slidable self-close latch selectively positionable within the housing;

a rotatable cam element in the housing, wherein the rotatable cam element comprises integrally formed first and second cam surfaces of similar shape but different size;

a flexible link extending around the cam element; and a spring applying stored force to the slidable self-close latch through the flexible link;

wherein the flexible link comprises a first flexible link attached to the first cam surface at a first end thereof and wrapping around the first cam surface, the first flexible link further attaching to an end of the spring at a second end thereof.

2. The self-close drawer mechanism of claim 1, wherein the flexible link further comprises a second flexible link attached to the second cam surface at a first end thereof and wrapping around the second cam surface, and the second flexible link further attaching to the slidable self-close latch at a second end thereof.

3. The self-close drawer mechanism of claim 1, wherein the second cam surface is larger than the first cam surface.

4. The self-close drawer mechanism of claim 2, wherein each of the first and second cam surfaces comprise an arcuate section and a flat section opposing the arcuate section.

5. The self-close drawer mechanism of claim 4, in combination with a drawer.

6. A self-close drawer mechanism comprising:

a housing;

a slidable self-close latch selectively positionable within the housing along a guided path;

a rotating dual-cam force loading element in the housing;

first and second flexible links extending around different portions of the rotating dual-cam force loading element; and a spring attached to the first flexible link, and the second flexible link being attached to the self-close latch, wherein the spring applies stored force to the sliding self-close latch through the first and second flexible links with a gradually reducing pulling force as the self-close drawer mechanism is unlatched.

7. The self-close drawer mechanism of claim 6, wherein the different portions of the rotating dual-cam force loading element respectively comprise integrally formed first and second cam surfaces of similar shape but different size.

8. The self-close drawer mechanism of claim 7, wherein the respective first and second cam surfaces each include a flat section and a curved section.

9. The self-close drawer mechanism of claim 8, wherein the second cam surface is larger than the first cam surface.

10. The self-close drawer mechanism of claim 6, in combination with a cabinet.

11. The self-close drawer mechanism of claim 10, wherein the cabinet is an appliance cabinet.

12. The self-close drawer mechanism of claim 11, wherein the appliance cabinet is a refrigerator cabinet.

13. A self-closing drawer assembly comprising:

a drawer having a catch latch; and an integrated self-close assembly interfacing with the catch latch, wherein the integrated self-close assembly comprises:

a housing a slidable self-close latch selectively positionable within the housing along a guided path by the catch latch in an opening operation of the drawer;

a rotatable dual-cam force loading element in the housing;

first and second flexible links extending around respectively different portions of the rotatable dual-cam force loading element; and a spring attached to the first flexible link and the second flexible link being attached to the self-close latch, wherein the spring applies stored force to the sliding self-close latch through the first and second flexible links with a gradually reduced pulling force as the self-close assembly is unlatched in the opening operation.

14. The self-closing drawer assembly of claim 13, wherein the different portions of the rotatable dual-cam force loading element each respectively comprise integrally formed first and second cam surfaces of similar shape but different size.

15. The self-closing drawer assembly of claim 14, wherein the second cam surface is larger than the first cam surface.

16. The self-closing drawer assembly of claim 14, wherein each of the first and second cam surfaces comprises an arcuate section and a flat section opposing the arcuate section.

17. The self-closing drawer assembly of claim 13, wherein the drawer is a refrigeration drawer.

* * * * *